US006923133B1

(12) United States Patent
Ross et al.

(10) Patent No.: US 6,923,133 B1
(45) Date of Patent: Aug. 2, 2005

(54) BOATLIFT BUOYANCY SYSTEM

(76) Inventors: Jay Ross, 39158 Woodland Dr. SE., Erskine, MN (US) 56535; Lance Hendrickson, 12433 Maple Lake Dr. SE., Mentor, MN (US) 56736

( * ) Notice: Subject to any disclaimer, the term of this patent is extended or adjusted under 35 U.S.C. 154(b) by 0 days.

(21) Appl. No.: 10/634,259

(22) Filed: Aug. 4, 2003

(51) Int. Cl.[7] ..... B63C 1/02
(52) U.S. Cl. ..... 114/45; 405/3
(58) Field of Search ..... 114/44–49, 52; 405/3

(56) References Cited

U.S. PATENT DOCUMENTS 821,110 A 5/1906 Mehlhorn et al.
3,976,022 A * 8/1976 Lapeyre ..... 114/45
4,018,179 A * 4/1977 Rutter ..... 114/45
4,072,119 A * 2/1978 Williams ..... 114/45
4,280,429 A 7/1981 Wells ..... 114/45
4,641,595 A * 2/1987 Pritchett ..... 114/44
5,549,070 A * 8/1996 Cruchelow et al. ..... 114/263

* cited by examiner

*Primary Examiner*—Ed Swinehart

(57) ABSTRACT

A boatlift buoyancy system for assisting in maneuvering a boatlift while in the water by adding buoyancy to the boatlift. The boatlift buoyancy system includes a first tube and a second tube attachable to the horizontal support beams of a boatlift that are capable of receiving of volume of air and/or water. A first hose and a second hose are fluidly connected to the first tube and second tube respectively for delivering pressurized air when buoyancy is desired for the boatlift. The first tube and the second tube also have a first aperture and a second aperture respectively within lower portions thereof for allowing for the draining of water when pressurized air is input into the tubes.

14 Claims, 8 Drawing Sheets

BOATLIFT BUOYANCY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to boatlifts and more specifically it relates to a boatlift buoyancy system for assisting in maneuvering a boatlift while in the water by adding buoyancy to the boatlift.

2. Description of the Related Art

Boatlifts have been in use for years for supporting boats during non-usage. FIG. 1 of the drawings illustrates an exemplary boatlift that the present invention may be utilized upon. Boatlifts are typically comprised of a tubular metal structure (e.g. aluminum, steel, etc.) and are relatively heavy. Boatlifts can exceed 600 pounds and are very difficult to maneuver even when positioned in deep water.

While these devices may be suitable for the particular purpose to which they address, they are not as suitable for assisting in maneuvering a boatlift while in the water by adding buoyancy to the boatlift. Conventional boatlifts are difficult to maneuver because of their weight, size and awkwardness.

In these respects, the boatlift buoyancy system according to the present invention substantially departs from the conventional concepts and designs of the prior art, and in so doing provides an apparatus primarily developed for the purpose of assisting in maneuvering a boatlift while in the water by adding buoyancy to the boatlift.

BRIEF SUMMARY OF THE INVENTION

In view of the foregoing disadvantages inherent in the known types of boatlifts now present in the prior art, the present invention provides a new boatlift buoyancy system construction wherein the same can be utilized for assisting in maneuvering a boatlift while in the water by adding buoyancy to the boatlift.

The general purpose of the present invention, which will be described subsequently in greater detail, is to provide a new boatlift buoyancy system that has many of the advantages of the boatlifts mentioned heretofore and many novel features that result in a new boatlift buoyancy system which is not anticipated, rendered obvious, suggested, or even implied by any of the prior art boatlifts, either alone or in any combination thereof.

To attain this, the present invention generally comprises a first tube and a second tube attachable to the horizontal support beams of a boatlift that are capable of receiving of volume of air and/or water. A first hose and a second hose are fluidly connected to the first tube and second tube respectively for delivering pressurized air when buoyancy is desired for the boatlift. The first tube and the second tube also have a first aperture and a second aperture respectively within lower portions thereof for allowing for the draining of water when pressurized air is input into the tubes.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a boatlift buoyancy system that will overcome the shortcomings of the prior art devices.

A second object is to provide a boatlift buoyancy system for assisting in maneuvering a boatlift while in the water by adding buoyancy to the boatlift.

Another object is to provide a boatlift buoyancy system that may be attached to various types of boatlifts.

An additional object is to provide a boatlift buoyancy system that significantly decreases the effective weight of a boatlift within water.

A further object is to provide a boatlift buoyancy system that is easy to utilize.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
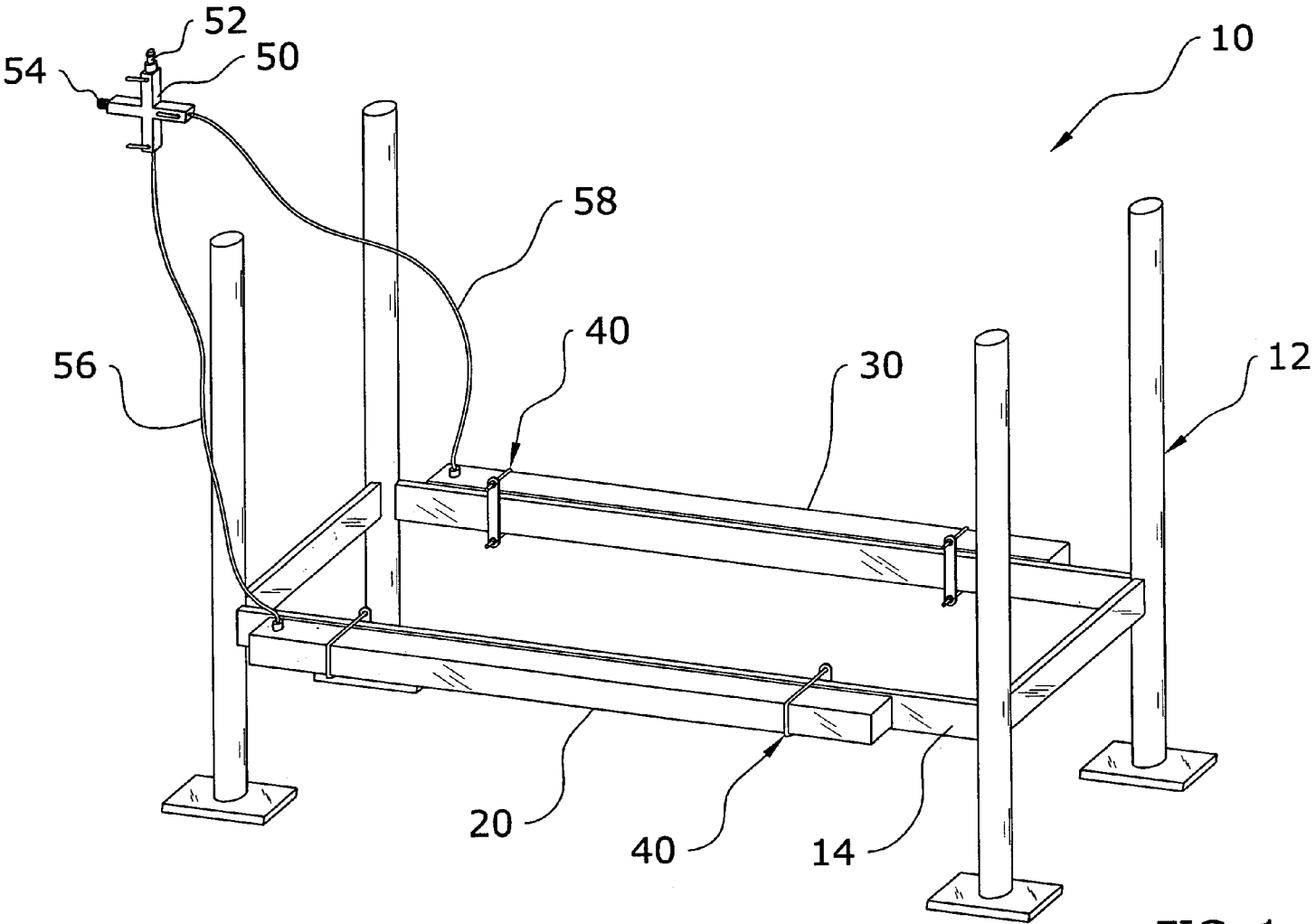
FIG. 1 is an upper perspective view of the present invention attached to the horizontal support beams of the boatlift.

Turning now descriptively to the drawings, in which similar reference characters denote similar elements throughout the several views, FIGS. 1 through 8 illustrate a boatlift buoyancy system 10, which comprises a first tube 20 and a second tube 30 attachable to the horizontal support beams 14 of a boatlift 12 that are capable of receiving of volume of air and/or water. A first hose 56 and a second hose 58 are fluidly connected to the first tube 20 and second tube 30 respectively for delivering pressurized air when buoyancy is desired for the boatlift 12. The first tube 20 and the second tube 30 also have a first aperture 22 and a second aperture 32 respectively within lower portions thereof for allowing for the draining of water when pressurized air is input into the 20, 30.

B. Buoyancy Tubes

The first tube 20 and the second tube 30 each have a tubular structure having an interior cavity. The first tube 20 and the second tube 30 are preferably removably attachable to a boatlift 12 as shown in FIGS. 1 through 3*b* of the drawings. The 20, 30 may be comprised of various materials such as but not limited to plastic, composite, fiberglass, aluminum and the like.

The 20, 30 are preferably an elongate horizontal structure as shown in FIGS. 1 through 7 of the drawings, however the 20, 30 may be comprised of a various other structures. The 20, 30 are also sealed within the upper portion thereof to prevent the escape of pressurized air. The 20, 30 may have various cross sectional shapes, sizes and lengths as can be appreciated.

The 20, 30 are capable of receiving of predefined volume of air and/or water. The 20, 30 preferably have a combined interior volume that allows for a substantial off-setting of the dry-weight of the boatlift 12. It is desirable that the water displacement not exceed the dry-weight of the boatlift 12 to avoid over-flotation of the boatlift 12 which would be difficult to maneuver. It is desirable to size the 20, 30 so that when the 20, 30 are completely filled with pressurized air they off-set approximately 40–90% of the dry-weight of the boatlift 12.

Figure 2:
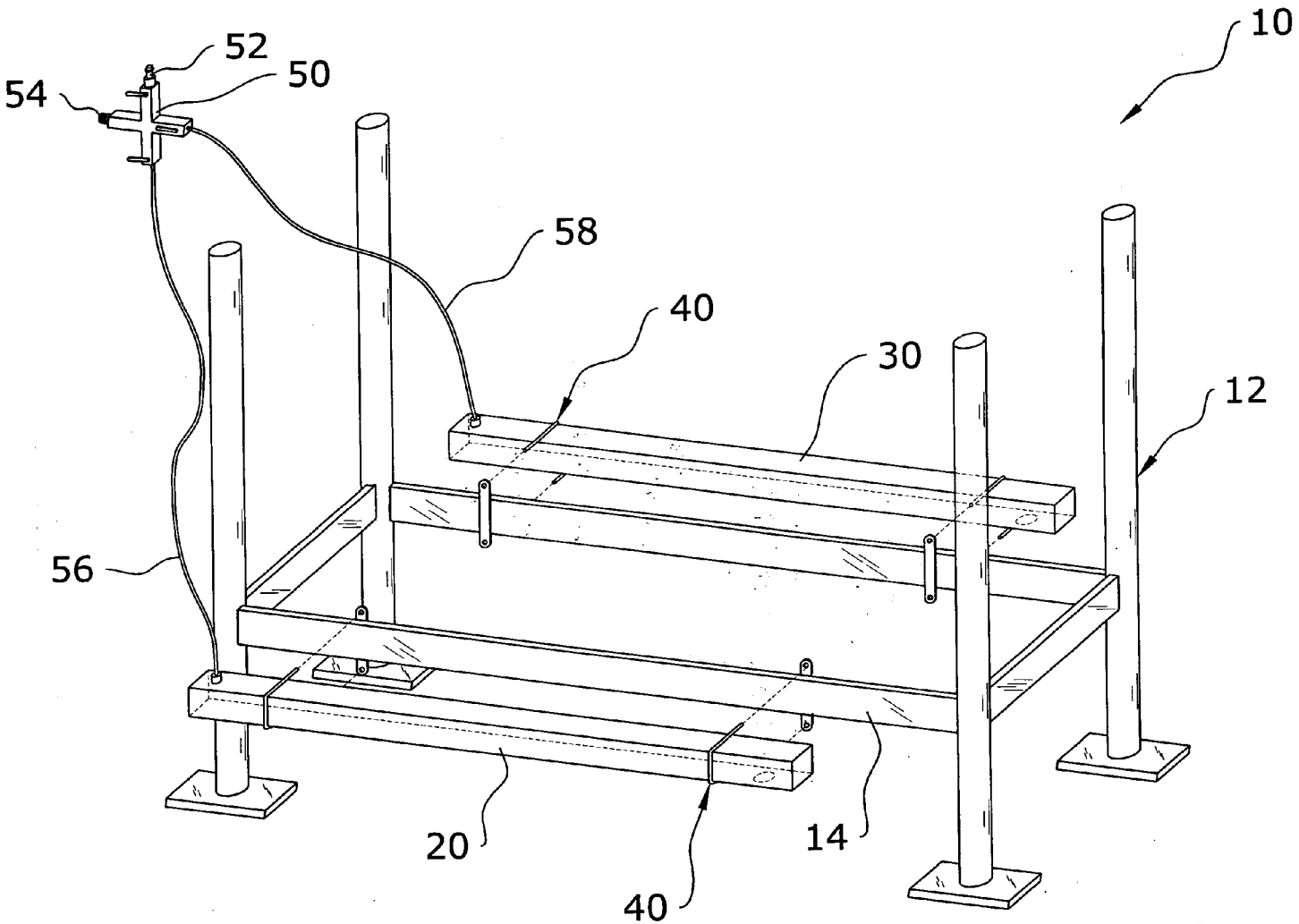
FIG. 2 is an exploded upper perspective view of the present invention with respect to the horizontal support beams of the boatlift.
Figure 7:
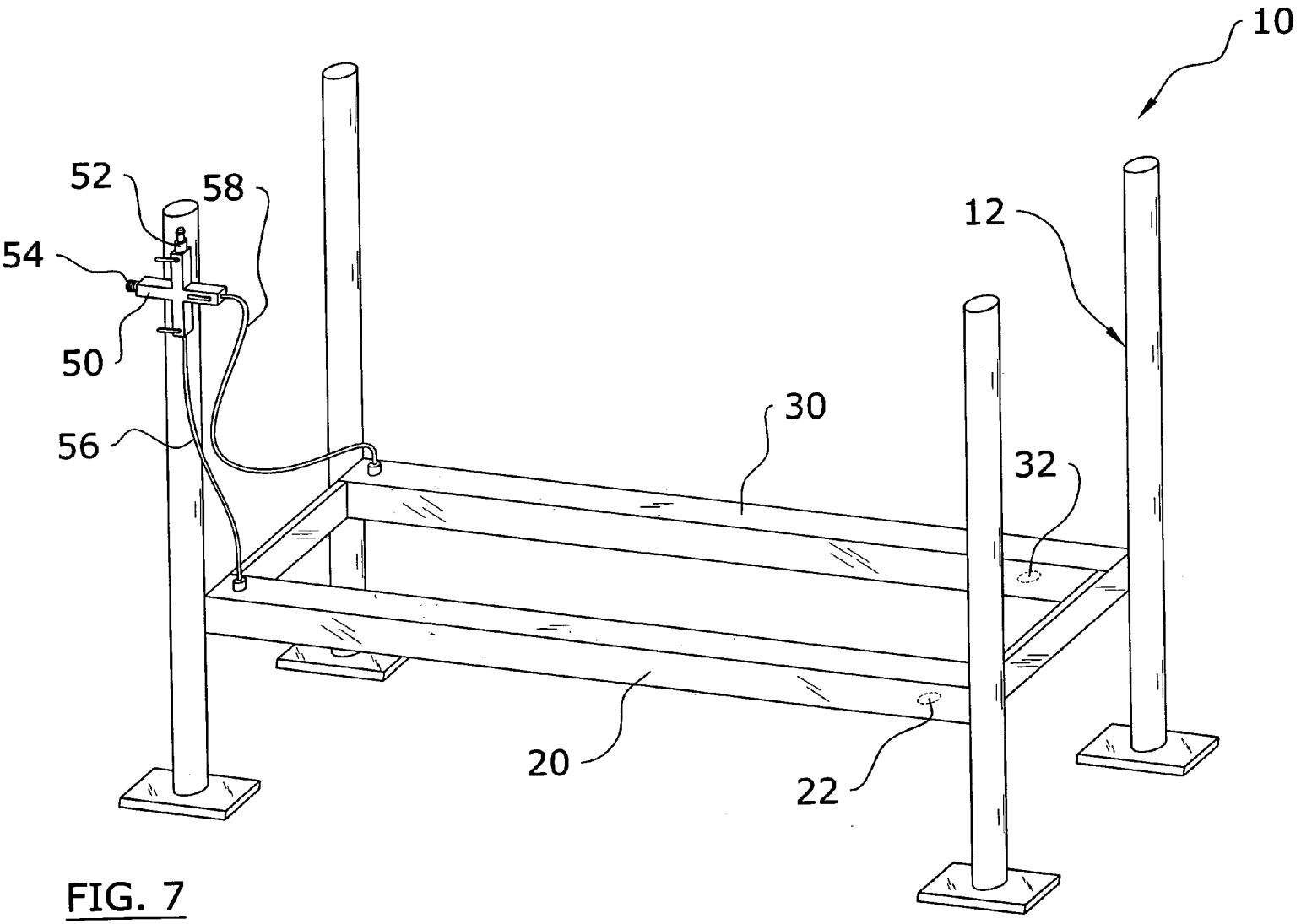
FIG. 7 is an upper perspective of a third embodiment of the present invention wherein the tubes are the support beams.

The 20, 30 are preferably removably attached to the horizontal support beams 14 of a boatlift 12 by attachment brackets 40 as shown in FIGS. 1 and 2 of the drawings. The 20, 30 are preferably orientated substantially horizontal when attached to a boatlift 12 as shown in FIG. 1 of the drawings. It can be appreciated that the 20, 30 may be permanently attached to the boatlift 12 also. Also, the 20, 30 may be comprised of part of the frame of the boatlift 12. (e.g. the horizontal support beams 14) as shown in FIG. 7 of the drawings.

As best shown in FIGS. 4 through 7 of the drawings, the first tube 20 and the second tube 30 have a first aperture 22, and a second aperture 32 respectively within lower portions thereof. The first aperture 22 and the second aperture 32 allow for draining of water when pressurized air is input into the 20, 30 and for allowing water to enter the 20, 30 when pressurized air is allowed to escape from the 20, 30.

A first screen 24 and a second screen 34 are preferably positioned about the first aperture 22 and the second aperture 32 for keeping debris from entering within the 20, 30. The first screen 24 and the second screen 34 are preferably comprised of a wire mesh material, however various other materials may be utilized.

C. Air Hoses

A first hose 56 and a second hose 58 are fluidly connected to the first tube 20 and the second tube 30 respectively for providing pressurized air for increasing buoyancy and for releasing pressurized air for reducing buoyancy. The first hose 56 and the second hose 58 may be comprised of any tubular structure capable of transferring slightly pressurized air.

Figure 6:
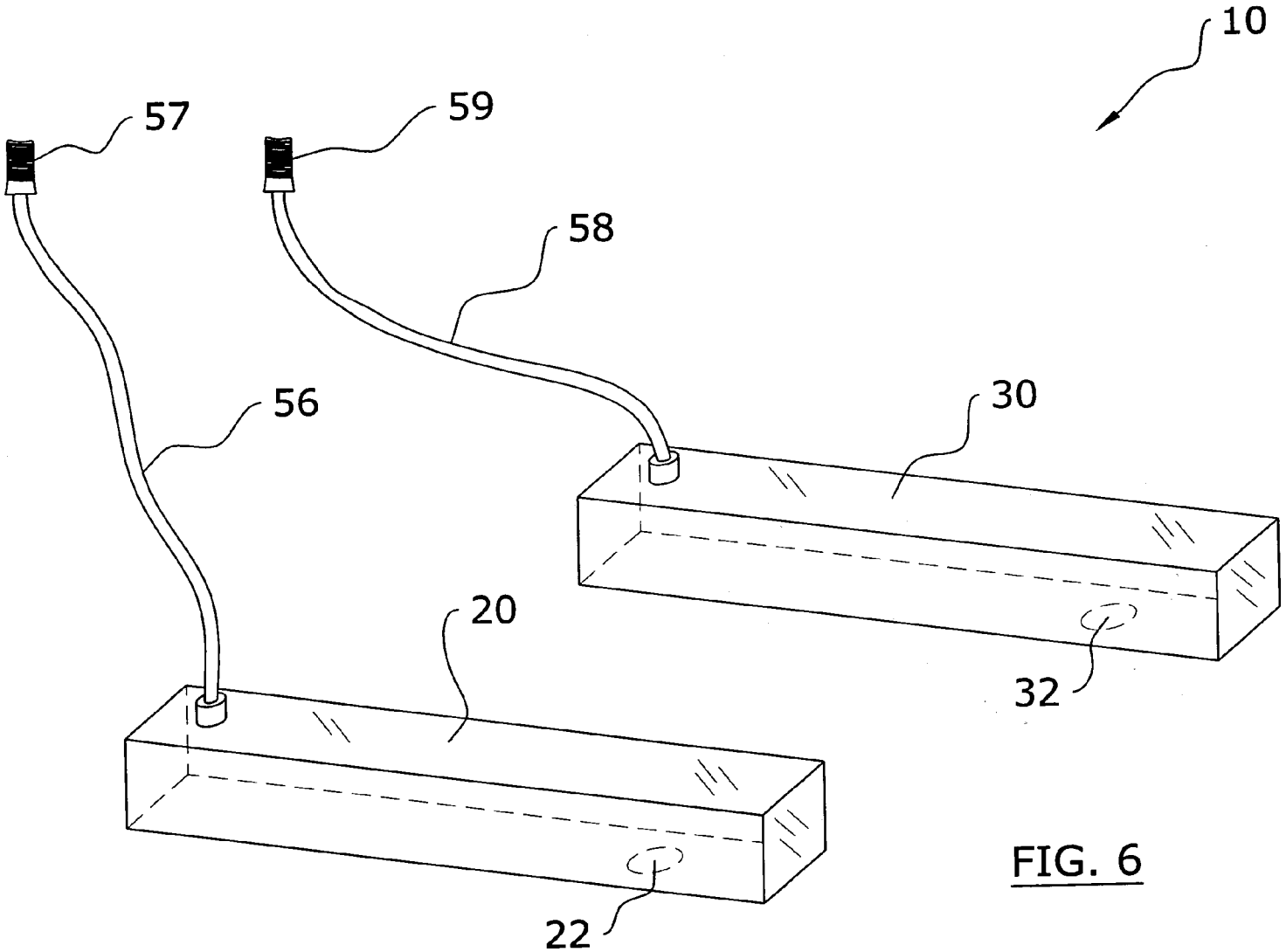
FIG. 6 is an upper perspective view of a second embodiment of the present invention wherein the first hose and the second hose have a first nozzle and a second nozzle respectively for receiving pressurized air.

As shown in FIG. 6 of the drawings, the first hose 56 and the second hose 58 may have a first nozzle 57 and a second nozzle 59 respectively for allowing input of pressurized air by a conventional air supply (e.g. air compressor, air tank, etc.). The first nozzle 57 and the second nozzle 59 preferably have a valve structure such as an automatic valve structure that closes when the air supply is not fluidly connected to prevent the escape of pressurized air. A manual valve structure may also be utilized within the first nozzle 57 and the second nozzle 59 to control the air within the 20, 30.

Figure 4:
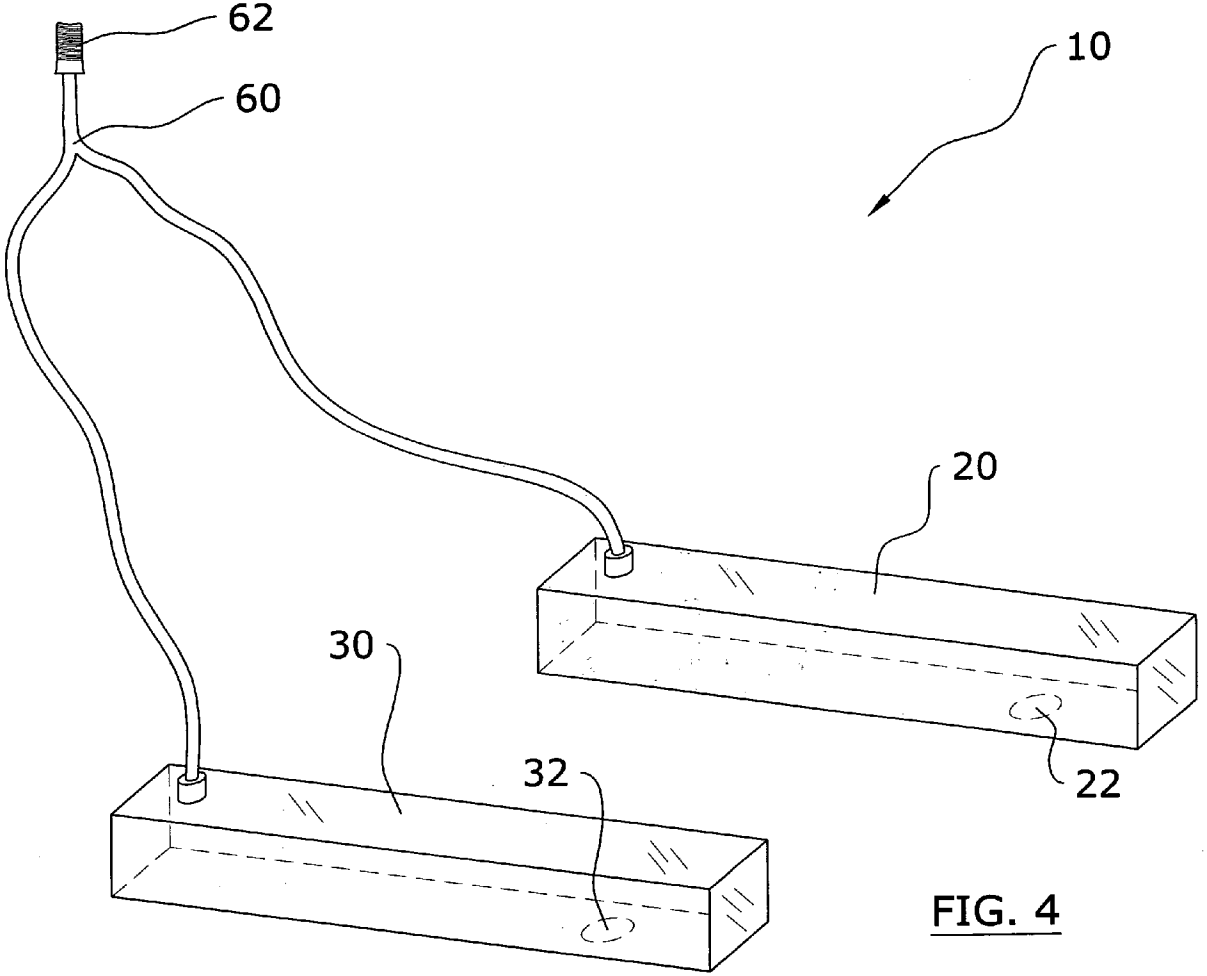
FIG. 4 is an upper perspective view of a first embodiment wherein a connecting hose is utilized to fluidly connect the first hose and the second hose.
Figure 5:
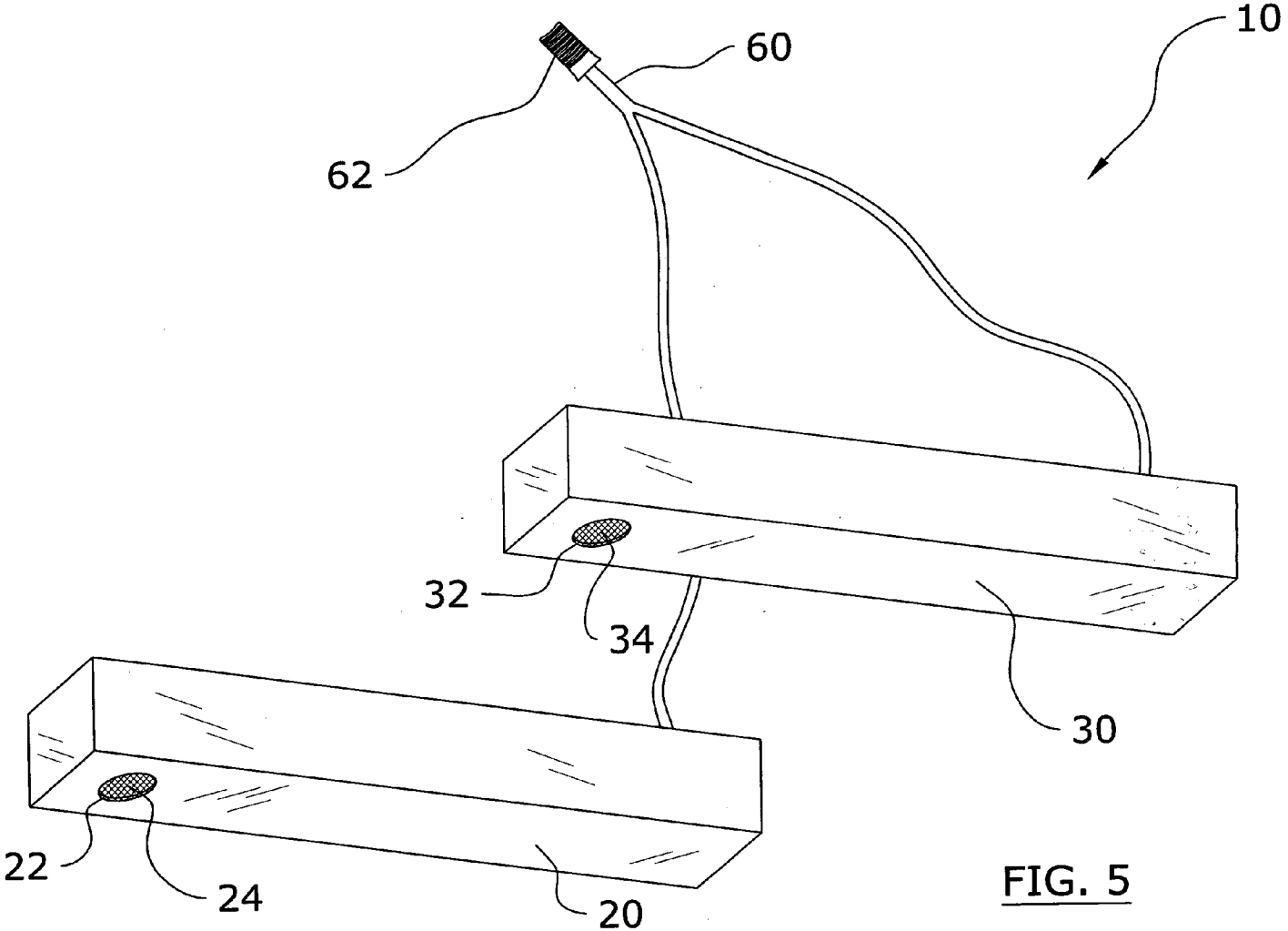
FIG. 5 is a lower perspective view of the present invention illustrating the first aperture and the second aperture with the lower portion of the tubes.

Alternatively, a connecting hose 60 having a connecting nozzle 62 may be fluidly connected to the first hose 56 and the second hose 58 as shown in FIGS. 4 and 5 of the drawings. As with the first nozzle 57 and the second nozzle 59, the connecting nozzle 62 preferably has an automatic or manual valve structure.

Figure 8:
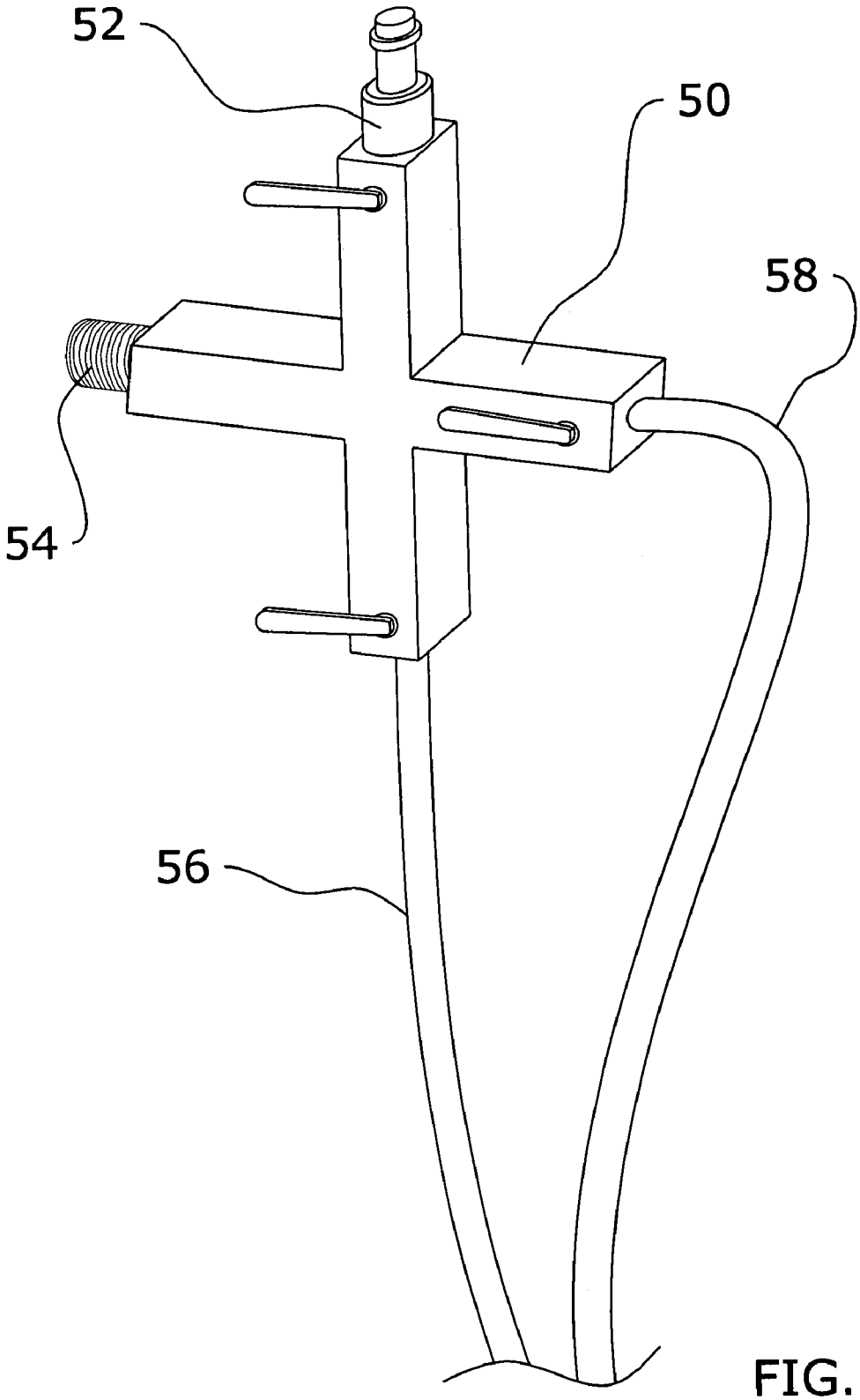
FIG. 8 is a magnified upper perspective view of the valve unit.

In addition, a valve unit 50 may be fluidly connected to the first hose 56 and the second hose 58 as shown in FIGS. 1, 2, 7 and 8 of the drawings. The valve unit 50 controls the air flow to the 20, 30 and the air flow from the 20, 30. The valve unit 50 preferably includes a fill nozzle 54 for inputting pressurized air and a release valve 52 for releasing pressurized air from the 20, 30 as shown in FIG. 8 of the drawings. The valve unit 50 preferably includes a plurality of manual valves for allowing control of the flow of air through the first hose 56 and the second hose 58 as shown in FIG. 8 of the drawings.

D. Attachment Brackets

As stated previously, the first tube 20 and the second tube 30 are removably attachable to a boat lift by a plurality of attachment brackets 40. Various types of attachment brackets 40 may be utilized to attach the 20, 30 to the boatlift 12 other than illustrated in the drawings.

However, the attachment brackets 40 are preferably comprised of a U-member with threaded distal ends, a plate with a plurality of apertures for receiving the U-member, and a plurality of fastener nuts threadably attachable to the threaded distal ends as best illustrated in FIG. 2 of the drawings. The U-member is secured about the 20, 30 with the plate positioned on the interior side of the support beams 14 of the boatlift 12.

E. Operation of Invention

Figure 3A:
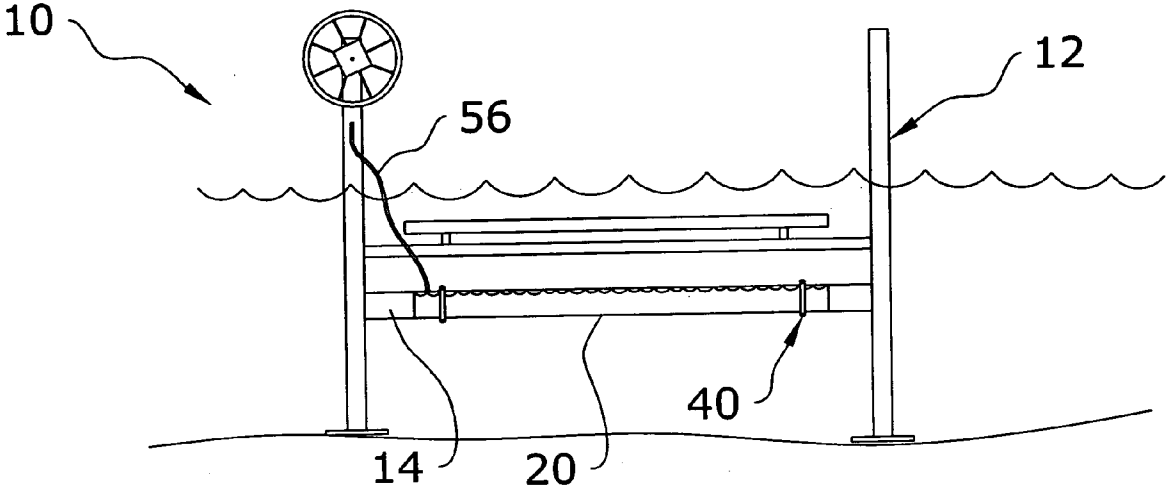
FIG. 3*a* is a side view of the present invention attached to a boatlift wherein the tubes are substantially filled with water thereby having limited buoyancy.
Figure 3B:
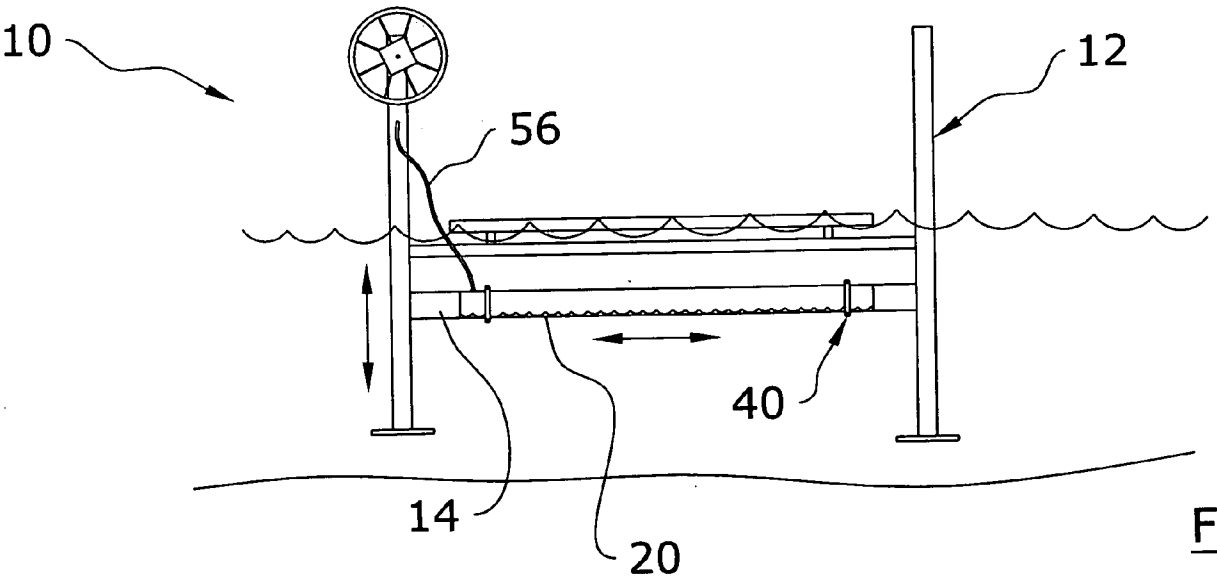
FIG. 3*b* is a side view of the present invention attached to a boatlift wherein the tubes are substantially filled with air thereby having increased buoyancy.

If the user desires to reduce the effective weight of the boatlift 12 for increasing maneuverability, the user inputs pressurized air into the first tube 20 and the second tube 30 thereby expelling any water within the 20, 30 through the apertures and increasing the buoyancy of the 20, 30 as shown in FIG. 3*b* of the drawings. The user is then able to easily maneuver the boatlift 12 within the water without having to exert a significant amount of force.

When the boatlift 12 is in the desired location, the user then releases the pressurized air from the first tube 20 and the second tube 30 thereby allowing water to enter the 20, 30 through the apertures and reducing the buoyancy of the 20, 30. The user then may disconnect the pressurized air supply from the invention and utilize the boatlift 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A boatlift buoyancy system, comprising:

a first tube and a second tube removably attachable to a plurality of horizontal support beams of a boatlift, wherein said tubes are capable of receiving a volume of air and/or water;

wherein said plurality of horizontal support beams are immovably affixed to a plurality of vertical post members, wherein said vertical post members have an upper end and a lower end, and wherein said lower end of each of said vertical post members is in engagement with a bottom of a lake or a river; and a first hose and a second hose fluidly connected to said first tube and said second tube respectively for providing pressurized air for creating buoyancy.

2. The boatlift buoyancy system of claim 1, wherein said first tube and said second tube are removably attachable to a boatlift by a plurality of attachment brackets.

3. The boatlift buoyancy system of claim 2, wherein said attachment brackets are comprised of a U-member with threaded distal ends, a plate with a plurality of apertures for receiving said U-member, and a plurality of fastener nuts threadably attachable to said threaded distal ends.

4. The boatlift buoyancy system of claim 1, wherein said tubes are orientated substantially horizontal when attached to a boatlift.

5. The boatlift buoyancy system of claim 1, wherein said first hose and said second hose have a first nozzle and a second nozzle for allowing input of pressurized air, wherein said first nozzle and said second nozzle have a valve structure.

6. The boatlift buoyancy system of claim 1, including a valve unit fluidly connected to said first hose and said second hose, wherein said valve unit includes a fill nozzle and a release nozzle.

7. The boatlift buoyancy system of claim 1, including a connecting hose having a connecting nozzle, wherein said connecting hose is fluidly connected to said first hose and said second hose and wherein said connecting nozzle has a valve structure.

8. The boatlift buoyancy system of claim 1, wherein said first tube and said second tube have a first aperture and a second aperture respectively within lower portions thereof for allowing draining of water when pressurized air is input into said tubes and for allowing water to enter said tubes when pressurized air is allowed to escape from said tubes.

9. The boatlift buoyancy system of claim 8, including a first screen and a second screen positioned about said first aperture and said second aperture for keeping debris from entering within said tubes.

10. A boatlift buoyancy system, comprising:

a boatlift having a first tube and a second tube attached in a horizontal manner to a plurality of horizontal support beams immovably positioned between a plurality of vertical post members, wherein said tubes are capable of receiving a volume of air and/or water, wherein said vertical post members have an upper end and a lower end, and wherein said lower end of each of said vertical post members is in engagement with a bottom of a lake or a river;

wherein said first tube and said second tube have a first aperture and a second aperture respectively within lower portions thereof for allowing draining of water when pressurized air is input into said tubes and for allowing water to enter said tubes when pressurized air is allowed to escape from said tubes;

wherein as said tubes receive said volume of air, said plurality of horizontal support beams and said vertical post members simultaneously move in an upward manner; and a first hose and a second hose fluidly connected to said first tube and said second tube respectively for providing pressurized air for creating buoyancy.

11. The boatlift buoyancy system of claim 10, wherein said first hose and said second hose have a first nozzle and a second nozzle for allowing input of pressurized air, wherein said first nozzle and said second nozzle have a valve structure.

12. The boatlift buoyancy system of claim 10, including a valve unit fluidly connected to said first hose and said second hose, wherein said valve unit includes a fill nozzle and a release nozzle.

13. The boatlift buoyancy system of claim 10, including a connecting hose having a connecting nozzle, wherein said connecting hose is fluidly connected to said first hose and said second hose and wherein said connecting nozzle has a valve structure.

14. The boatlift buoyancy system of claim 10, including a first screen and a second screen positioned about said first aperture and said second aperture for keeping debris from entering within said tubes.

* * * * *